US009523965B2

(12) United States Patent
Liao

(10) Patent No.: US 9,523,965 B2
(45) Date of Patent: Dec. 20, 2016

(54) MODULAR PORTABLE STACKABLE DEVICE

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 162 days.

(21) Appl. No.: 14/522,224

(22) Filed: Oct. 23, 2014

(65) Prior Publication Data

US 2015/0124567 A1 May 7, 2015

(30) Foreign Application Priority Data

Nov. 4, 2013 (TW) ..... 102139896 A

(51) Int. Cl.

| | |
|---|---|
| ***G04B 47/06*** | (2006.01) |
| ***G04G 17/02*** | (2006.01) |
| ***G04G 17/04*** | (2006.01) |
| ***G04G 17/08*** | (2006.01) |
| ***A44C 5/00*** | (2006.01) |
| ***G04G 17/06*** | (2006.01) |
| ***G04G 21/02*** | (2010.01) |
| ***G04G 21/04*** | (2013.01) |

(52) U.S. Cl.

CPC ..... *G04G 17/06* (2013.01); *A44C 5/0015* (2013.01); *A44C 5/0053* (2013.01); *G04B 47/06* (2013.01); *G04G 17/083* (2013.01); *G04G 21/025* (2013.01); *G04G 21/04* (2013.01)

(58) Field of Classification Search

CPC ..... G04B 47/00; G04B 47/06; G04G 17/00; G04G 17/02; G04G 17/04; G04G 17/06; G04G 17/08; G04G 17/083; A44C 5/0015; A44C 5/0053

See application file for complete search history.

(56) References Cited

U.S. PATENT DOCUMENTS

| | | | | |
|---|---|---|---|---|
| 4,444,513 A * | 4/1984 | Proellochs | G04B 37/0427 | 368/223 |
| 5,262,763 A * | 11/1993 | Okuyama | G04G 9/0064 | 345/169 |
| 5,889,737 A * | 3/1999 | Alameh | G04C 10/00 | 368/204 |
| 6,027,828 A * | 2/2000 | Hahn | H01M 2/1022 | 429/100 |
| 6,619,835 B2 * | 9/2003 | Kita | A44C 5/0015 | 368/10 |
| 6,619,836 B1 * | 9/2003 | Silvant | G04G 17/08 | 368/281 |

(Continued)

*Primary Examiner* — Vit W Miska
(74) *Attorney, Agent, or Firm* — Li&Cai Intellectual Property (USA) Office

(57) ABSTRACT

A portable modularized stack device includes a flexible wristband and an electronic module. The flexible wristband has a belt which is embedded with wires therein. The belt has a receiving portion formed thereon, a first connector connected at one end of the belt and a second connector connected at the other end of the belt. The first connector and the second connector are matched correspondingly. The flexible wristband further has a third connector. The electronic module has a fourth connector and is disposed on the receiving portion of the flexible wristband. The fourth connector is connected to the third connector. Thus, the present invention can be varied and expanded by stacking another electronic device thereon, and the flexible wristband can be used as a transmission line.

10 Claims, 7 Drawing Sheets

(56) References Cited

U.S. PATENT DOCUMENTS

| | | | | |
|---|---|---|---|---|
| 7,978,465 | B2 * | 7/2011 | Osaka | G05B 19/05 248/917 |
| 8,385,075 | B2 * | 2/2013 | Loucks | G06F 1/1626 361/728 |
| 2007/0064542 | A1 * | 3/2007 | Fukushima | G04B 37/1486 368/282 |
| 2007/0279852 | A1 * | 12/2007 | Daniel | A44C 5/0007 361/679.03 |
| 2015/0199858 | A1 * | 7/2015 | Salmon | H04M 1/0256 340/5.51 |

* cited by examiner

MODULAR PORTABLE STACKABLE DEVICE

BACKGROUND OF THE INVENTION

1. Field of the Invention

The present disclosure relates to a portable device; in particular, to a modular portable stackable device which can be worn on wrists.

2. Description of Related Art

Time management is essential to people's lives. A device for showing the current time is needed at all times, so watches are necessary devices for contemporary people. The types of current watches are myriad (e.g. electronic watches, mechanical watches, waterproof watches, etc.), and of the devices carried by typical users, the watches are the least likely to be forgotten and occupy the least amount of space.

With the advancement of technology, the quality of life has increased, but modern diseases persist. Symptoms of many diseases can be measured quantitatively by measuring parameters of a human body, such has rate of heartbeat, blood pressure, blood glucose level, etc. Therefore, many types of portable devices on the current market can be worn on wrists, to facilitate automatic monitoring at all times.

However, conventional portable devices worn on wrists have fixed structures and simple functions, and cannot be expanded or modified according to a user's need.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present disclosure is to provide a modular portable stackable device which can be expanded and modified according to need, and can act as a transmission line.

In order to achieve the aforementioned objects, the present disclosure provides a modular portable stackable device, comprising: a flexible wristband having a belt, wherein the belt is embedded with wires therein and is formed with a receiving portion thereon, one end of the belt is connected to a first connector, another end of the belt is connected to a second connector, the first connector and the second connector are corresponding electrical connectors, and the flexible wristband has a third connector; and an electronic module having a fourth connector and disposed on the receiving portion of the flexible wristband, wherein the fourth connector is configured to connect to the third connector.

The present disclosure has the following advantages. The present disclosure includes the flexible wristband and the electronic module. The electronic module is stacked on the receiving portion of the flexible wristband, and can be expanded or modified according to need. The flexible wristband can also serve as a transmission line, for transmitting electric power or signals. The electronic module and the flexible wristband are electrically connected. The signal of the electronic module can be transmitted to other electronic devices through the flexible wristband.

In order to further the understanding regarding the present disclosure, the following embodiments are provided along with illustrations to facilitate the disclosure of the present disclosure.

DETAILED DESCRIPTION OF THE PREFERRED EMBODIMENTS

First Embodiment

Figure 1:
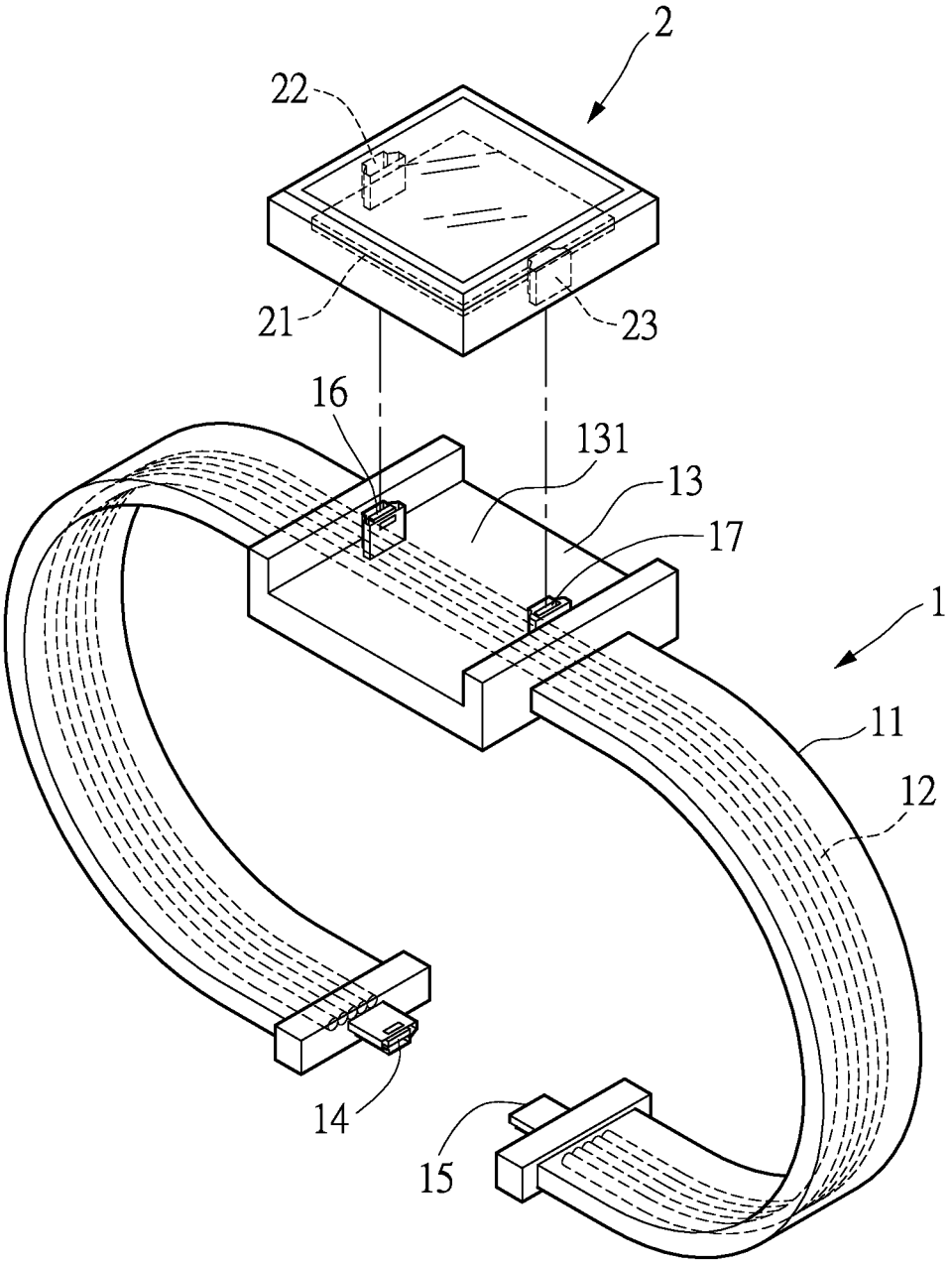
FIG. 1 shows an exploded view of a modular portable stackable device according to a first embodiment of the present disclosure.
Figure 2:
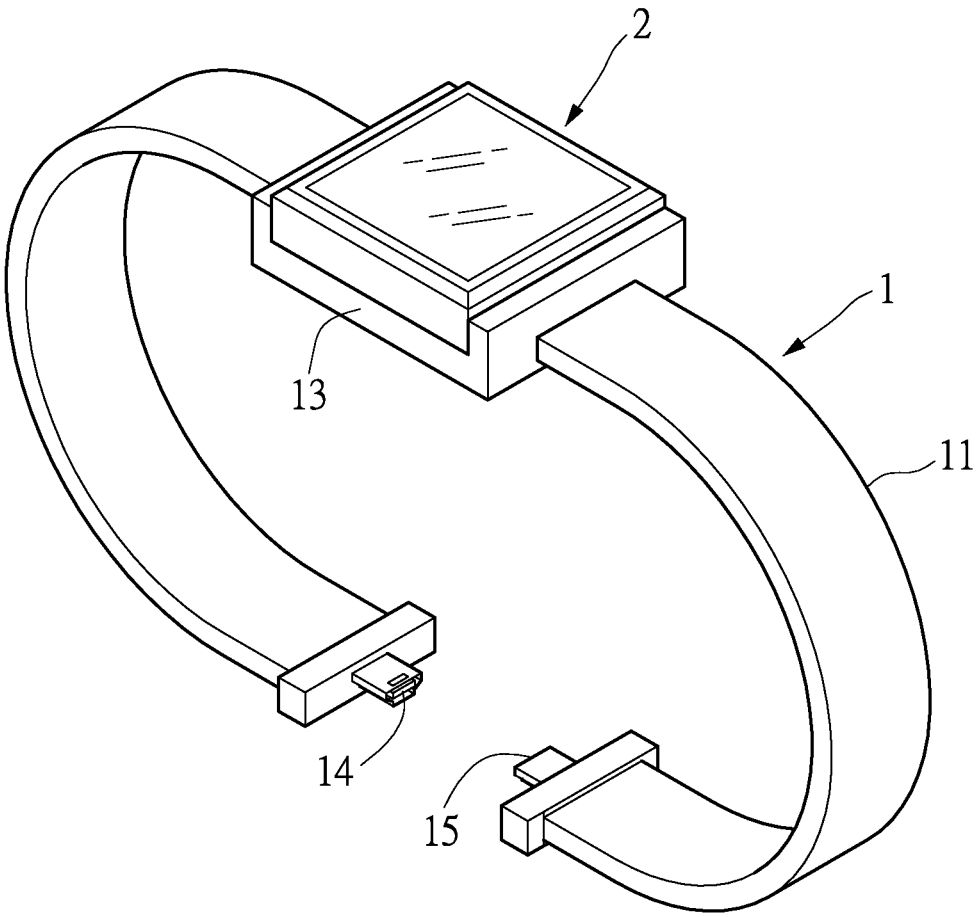
FIG. 2 shows a perspective view of an assembled modular portable stackable device according to a first embodiment of the present disclosure.

Referring to FIG. 1 and FIG. 2, the modular portable stackable device of the present disclosure comprises a flexible wristband 1 and an electronic module 2. The flexible wristband 1 has an elongated belt 11. The belt 11 is flexible, and can be bent to form a ring for being worn on a wrist. The belt 11 can also be bent into any shape or be stretched flat. The belt 11 is embedded with wires 12. The quantity and the structure of the wires 12 are not limited, and can be modified according to need. The wires 12 are preferably embedded in the wristband 11 but are not limited thereto. The wires 12 are conductive for transmitting electric power or signals.

The belt 11 is formed with a receiving portion 13. The receiving portion 13 is preferably arranged at the middle of the belt 11, but is not limited thereto. The receiving portion 13 has a receiving face 131 for accommodating the electronic module 2. The shape of the receiving portion 13 can correspond to the shape of the electronic module 2, such that the electronic module 2 can be snugly disposed on the receiving portion 13.

The two ends of the belt 11 are respectively connected to a first connector 14 and a second connector 15. Namely, the first connector 14 is connected to one end of the belt 11, and the second connector 15 is connected to another end of the belt 11. The first connector 14 and the second connector 15 are corresponding connectors. Namely, the first connector 14 can be a male connector or a female connector, and the second connector 15 can be correspondingly a female connector or a male connector, such that the first connector 14 and the second connector 15 can engage for fixing the belt 11 in an annular shape.

The first connector 14 and the second connector 15 can be electrical connectors. The form and structure of the first connector 14 and the second connector 15 is not limited, and can be a USB connector, an IEEE1394 connector, an HDMI connector, a display port connector, an RJ connector, an AV terminal, a DC terminal or an IPHONE connector, etc. The first connector 14 and the second connector 15 can be electrically connected to the wires 12, such that the flexible wristband 1 can form a transmission line.

When the first connector 14 and the second connector 15 are separated, the first connector 14 can engage a connector of an electronic device, and the second connector 15 can engage a connector of another electronic device, such that the two electronic devices can be electrically connected by the flexible wristband 1 for transmitting electric power or signals between the two electronic devices.

The flexible wristband 1 has a third connector 16, and can further have a fifth connector 17. The third connector 16 and the fifth connector 17 can be arranged at the edges or top portion of the receiving portion 13. The third connector 16 and the fifth connector 17 can be electrical connectors. The form and structure of the third connector 16 and the fifth connector 17 are not limited, and can be a USB connector, an IEEE1394 connector, an HDMI connector, a display port connector, an RJ connector, an AV terminal, a DC terminal or an IPHONE connector, etc. The third connector 16 and the fifth connector 17 are electrically connected to the wires 12, such that the electronic module 2 can be electrically connected to the flexible wristband 1 through the third connector 16 and the fifth connector 17.

The form of the electronic module 2 is not limited. The electronic module 2 can be a device for displaying time and date, such as a watch. The electronic module 2 can also be a detecting device for detecting physiological signals of a human body, such as heartbeat rate, blood pressure, body temperature, blood oxygen level, blood glucose level, etc. and displaying said signals. The electronic module 2 can also be a sports device for measuring time, speed and other data. Analysis and adjustments can be made during exercise according to the data displayed. The electronic module 2 can also be a battery module, a wireless module, etc. serving as a portable battery or wireless transmitter, etc. The electronic device 2 can also be a tracking device having GPS for identifying the location of the wearer, so that in cases of emergency help can be sent to the location given by GPS.

A circuit board 21 can be disposed in the electronic module 2. The structure of the circuit board 21 is not limited, and can be modified according to the form of the electronic module 2 for providing the appropriate function. The electronic module 2 has a fourth connector 22, and can further have a sixth connector 23. The fourth connector 22 and the sixth connector 23 can be arranged at the edges or the underside of the electronic module 2. The fourth connector 22 and the sixth connector 23 can be electrical connectors. The form and structure of the fourth connector 22 and the sixth connector 23 are not limited, and can be a USB connector, an IEEE1394 connector, an HDMI connector, a display port connector, an RJ connector, an AV terminal, a DC terminal or an IPHONE connector, etc. The fourth connector 22 and the sixth connector 23 are electrically connected to the circuit board 21.

When the electronic module 2 is disposed on the receiving portion 13 of the flexible wristband 1, the fourth connector 22 and the sixth connector 23 of the electronic module 2 respectively engage the third connector 16 and the fifth connector 17 of the flexible wristband 1, such that the electronic module 2 is securely stacked on the receiving portion 13. If the connectors 16, 17, 22, 23 are electrical connectors, the electronic module 2 and the flexible wristband 1 can be electrically connected. If the connectors 16, 17, 22, 23 are mechanical connectors instead of electrical connectors, then only a fixing function is provided. The electrical connection between the electronic module 2 and the flexible wristband 1 allows transmission of signals of the electronic module 2 to other electronic devices through the flexible wristband 1.

Second Embodiment

Figure 3:
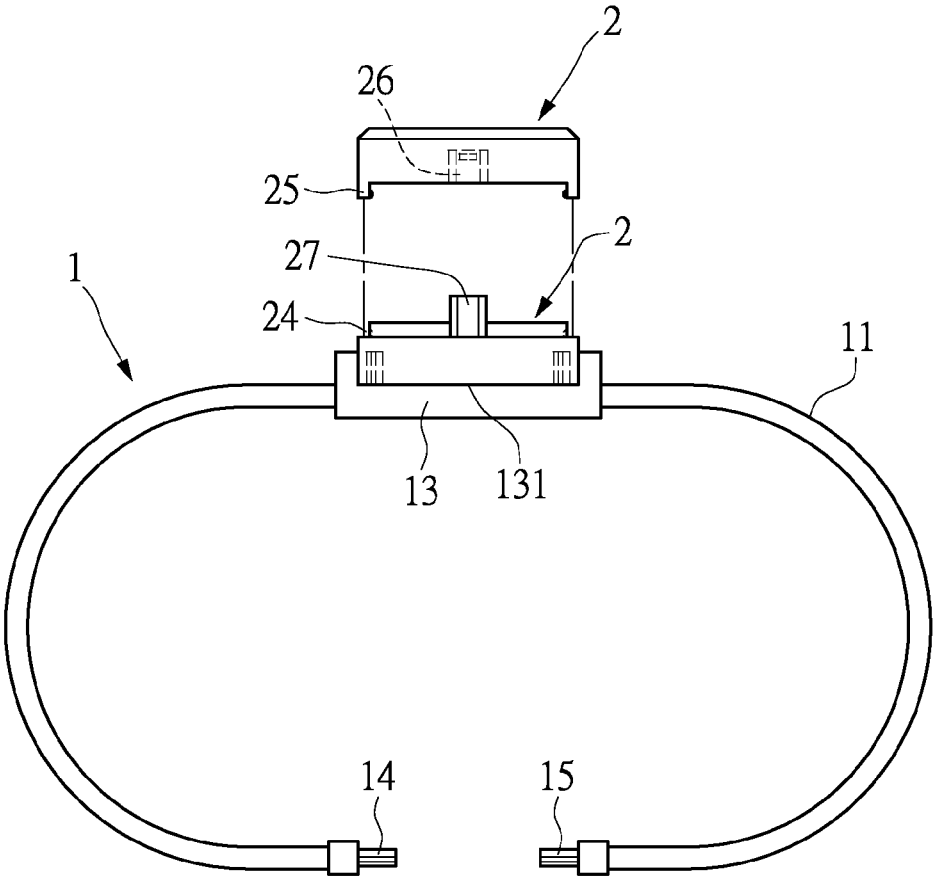
FIG. 3 shows a planar view of a modular portable stackable device according to a second embodiment of the present disclosure.

Referring to FIG. 3, one, two or more electronic modules 2 can be disposed according to need. The electronic modules 2 can be of different forms and functions. Any two neighboring electronic modules 2 have engagement structure therebetween. Namely, the top of the electronic module 2 can have a first engagement portion 24, and the underside of the electronic module 2 can have a second engagement portion 25. The first engagement portion 24 and the second engagement portion 25 can be an engagement groove and a corresponding engagement body, such that neighboring electronic modules 2 can be fixed through the engagement between the first engagement portion 24 and the second engagement portion 25, such that the electronic modules 2 can be securely stacked. Additionally, two neighboring electronic modules 2 can respectively have a seventh connector 26 and an eighth connector 27. The seventh connector 26 and the eighth connector 27 can be electrical connectors. The form and structure of the seventh connector 26 and the eighth connector 27 are not limited. When the electronic modules 2 are stacked, two neighboring electronic modules 2 can be electrically connected through the engagement between the seventh connector 26 and the eighth connector 27, such that the electronic modules 2 can all be electrically connected to the flexible wristband 1.

Third Embodiment

Figure 4:
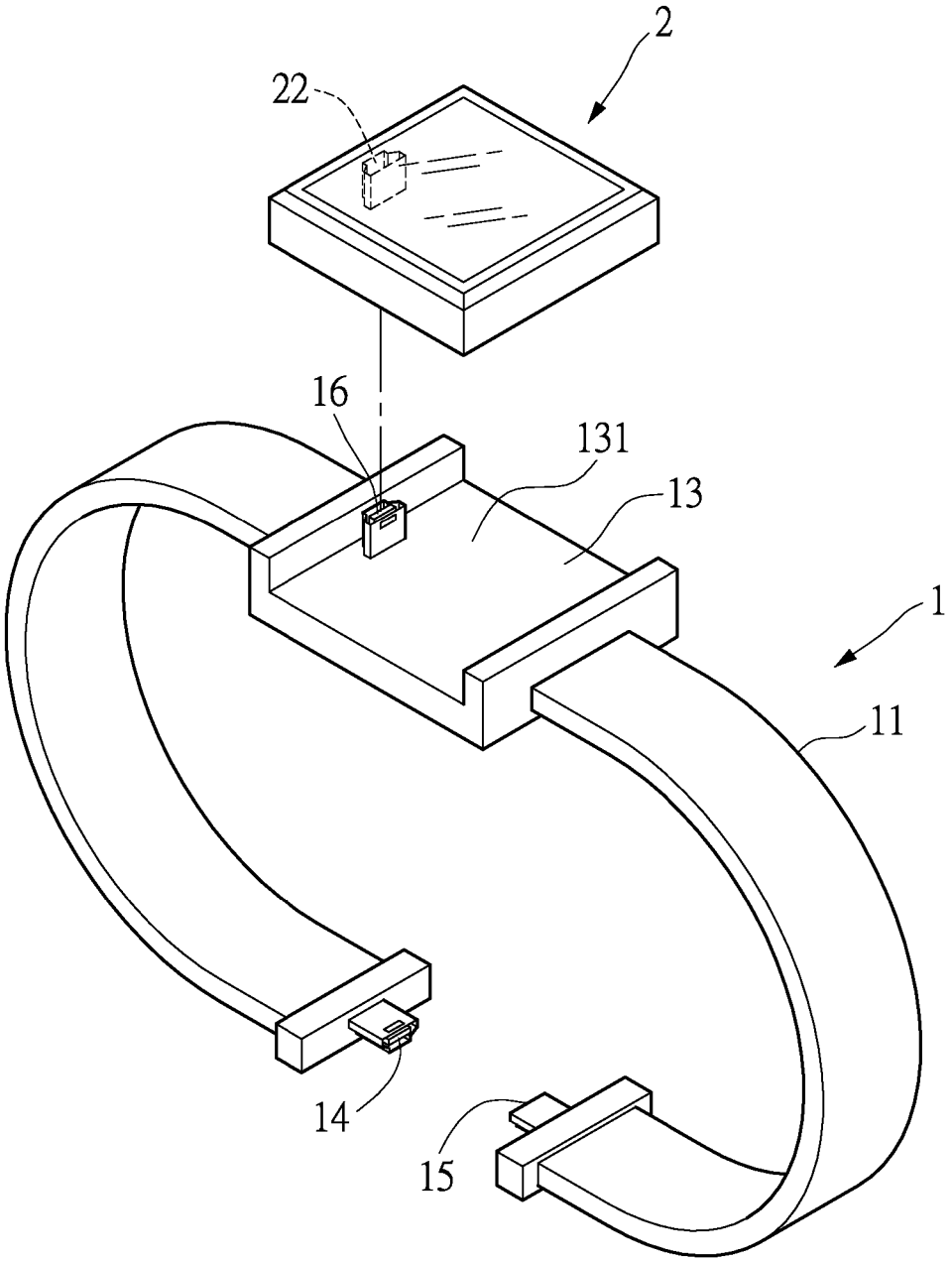
FIG. 4 shows an exploded view of a modular portable stackable device according to a third embodiment of the present disclosure.

Referring to FIG. 4, in the present embodiment the flexible wristband 1 has a third connector 16 electrically connected to the wires 12, such that the electronic module 2 can be electrically connected to the flexible wristband 1 through the third connector 16. The electronic module 2 has a fourth connector 22 electrically connected to the circuit board 21. When the electronic module 2 is stacked on the receiving portion 13 of the flexible wristband 1, the fourth connector 22 of the electronic module 2 can engage the third connector 16 of the flexible wristband 1, such that the electronic module 2 is securely stacked on the receiving portion 13. If the connectors 16, 22 are electrically connected, the electronic module 2 and the flexible wristband 1 can be electrically connected. If the connectors 16, 22 are mechanical connectors instead of electrical connectors, then only a fixing function is provided.

Fourth Embodiment

Figure 5:
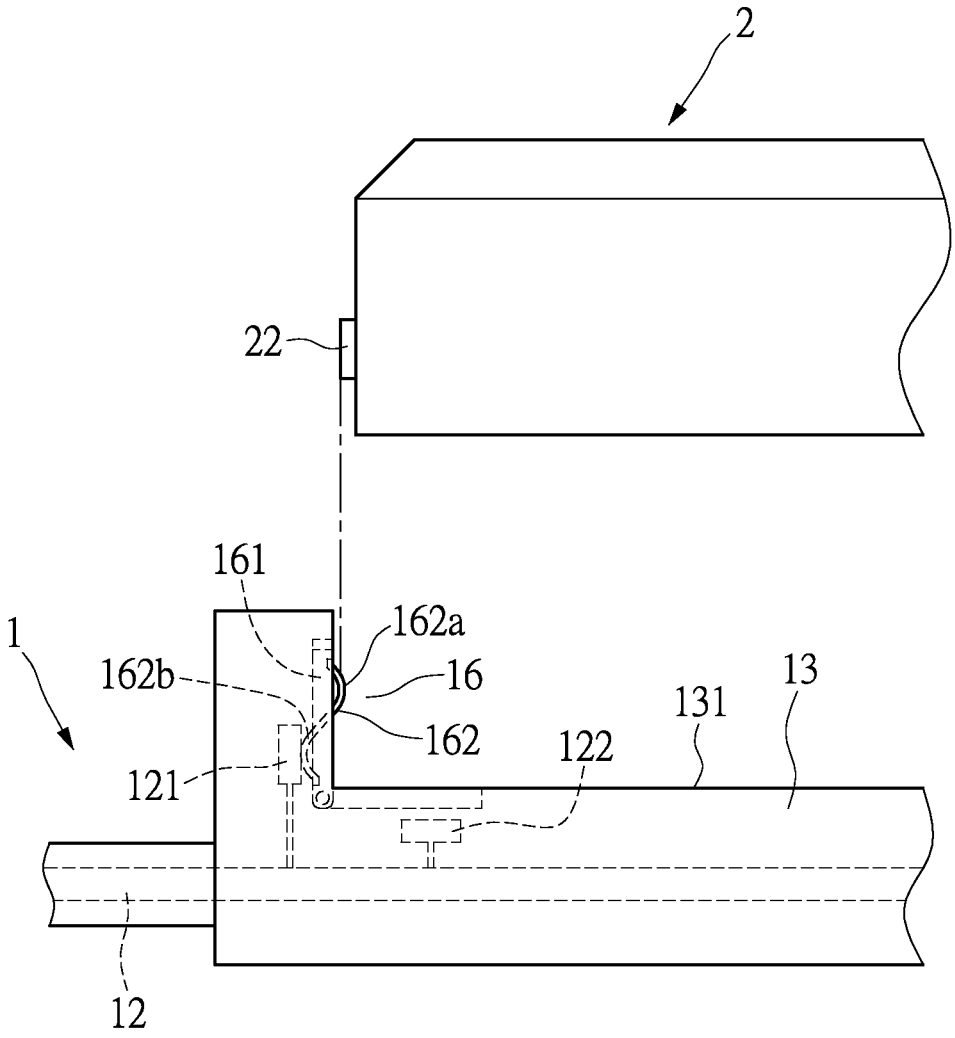
FIG. 5 shows a cross-sectional view of a modular portable stackable device according to a fourth embodiment of the present disclosure.
Figure 6:
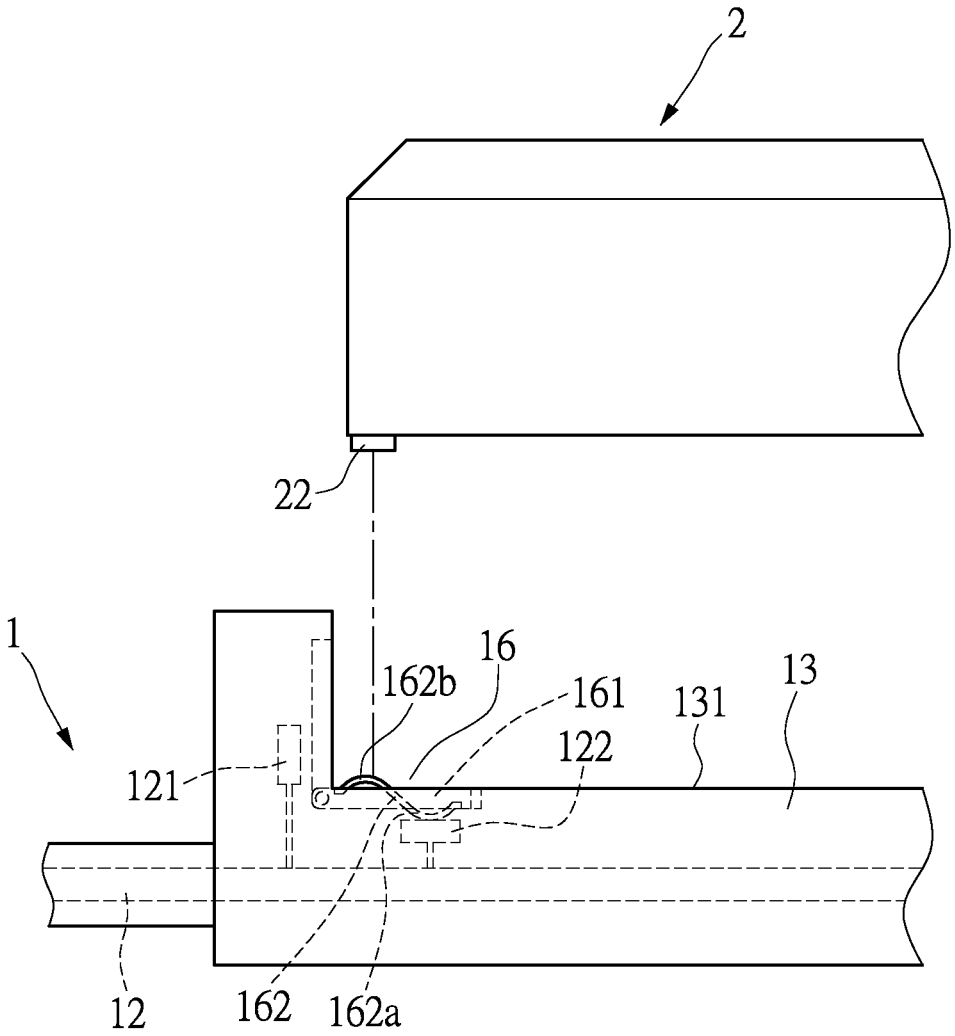
FIG. 6 shows a cross-sectional view of a modular portable stackable device in another state according to a fourth embodiment of the present disclosure.

Referring to FIG. 5 and FIG. 6, in the present embodiment, the third connector 16 has a terminal seat 161 flippably disposed on the receiving portion 13. A terminal 162 is disposed at the terminal seat 161. The quantity of the terminals 162 is not limited, and can be one, two or more. Each of the terminals 162 has a first contact portion **162*a* and a second contact portion 162*b*. The first contact portion 162*a* and the second contact portion 162*b* are respectively exposed at the two faces of the terminal seat 161. When the terminal seat 161 is upright (as shown in FIG. 5), the second contact portion 162*b* of the terminal 162 can be in contact with a first contact point 121 of the wires 12, such that the third connector 16 is electrically connected to the wires 12. When the electronic module 2 is tacked on the receiving portion 13 of the flexible wristband 1**, the fourth connector 22 arranged at an edge of the electronic module 2 can be electrically connected to the first contact portion 162*a* of the third connector 16. When the terminal seat 161 is laid flat (as shown in FIG. 6), the first contact portion 162*a* of the terminal 162 is in contact with a second contact point 122 of the wires 12, such that the third connector 16 is electrically connected to the wires 12. When the electronic module 2 is stacked on the receiving portion 13 of the flexible wristband 1, the fourth connector 22 arranged at the underside of the electronic module 2 can be electrically connected to the second contact portion 162*b* of the third connector 16. The third connector 16 of the present embodiment can be moved to accommodate the position of the fourth connector 22 of the electronic module 2.

The present disclosure includes a flexible wristband and an electronic module. The electronic module can be stacked on a receiving portion of the flexible wristband, and expanded and modified according to need. Moreover, the flexible wristband can serve as a transmission line for transmitting electric power or signals.

Fifth Embodiment

Figure 7:
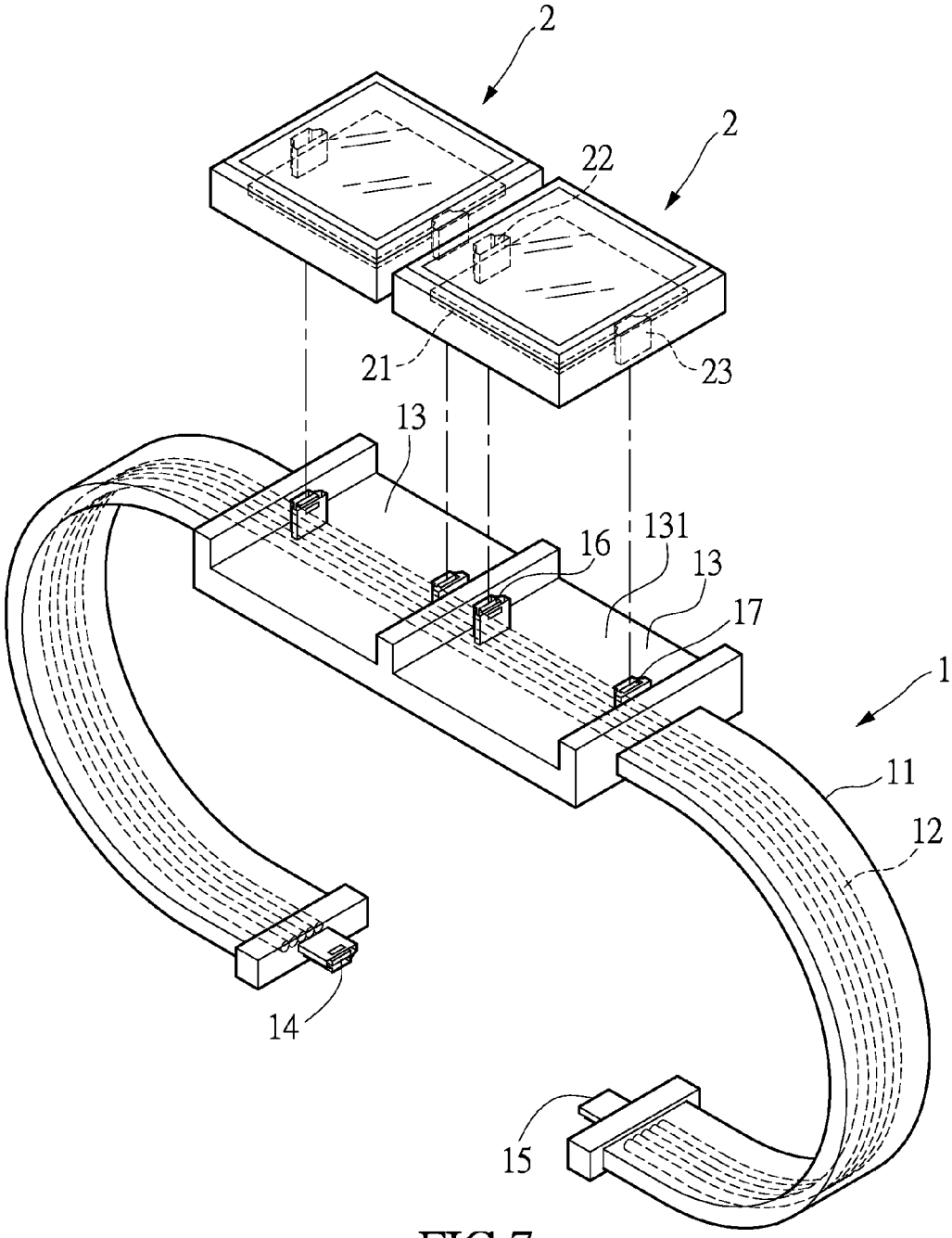
FIG. 7 shows an exploded view of a modular portable stackable device according to a fifth embodiment of the present disclosure.

Referring to FIG. 7, the present embodiment includes two receiving portions 13 and two electronic modules 2. The electronic modules 2 each have a fourth connector 22 and a sixth connector 23. The two electronic modules 2 are respectively disposed in the two receiving portions 13. The fourth connectors 22 and the sixth connectors 23 of the two electronic modules 2 are respectively connected to corresponding third connectors 16 and fifth connectors 17 of the flexible wristband 1.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A modular portable stackable device comprising:

a flexible wristband having a belt, wherein the belt has wires embedded therein and is formed with a receiving portion, one end of the belt is connected to a first connector, another end of the belt is connected to a second connector, the first connector and the second connector are corresponding electrical connectors, and the flexible wristband has a third connector; and an electronic module having a fourth connector and disposed on the receiving portion of the flexible wristband, wherein the fourth connector and the third connector are connected;

wherein the third connector has a terminal seat flippably disposed on the receiving portion, the terminal seat has a terminal; the terminal has a first contact portion and a second contact portion; the first contact portion and the second contact portion are respectively exposed at two faces of the terminal seat; when the terminal seat is upright, the second contact portion is in contact with a first contact point of the wires, and the fourth connector arranged at an edge of the electronic module is in contact with the first contact portion of the third connector; and when the terminal seat is laid flat, the first contact portion of the terminal is in contact with a second contact point of the wires, and the fourth connector arranged at the underside of the electronic module is in contact with the second contact portion of the third connector.

2. The modular portable stackable device according to claim 1, wherein the third connector and the fourth connector are electrical connectors, and the third connector 3 is electrically connected to the wires.

3. The modular portable stackable device according to claim 1, wherein the flexible wristband has a fifth connector electrically connected to the wires, the electronic module has a sixth connector, the fifth connector and the sixth connector are electrical connectors and are engaged.

4. The modular portable stackable device according to claim 1, wherein at least two electronic modules are disposed, the top of each of the electronic modules has a first engagement portion, the underside of each of the electronic modules has a second engagement portion, and any two neighboring electronic modules are fixed through engagement of the first engagement portion and the second engagement portion therebetween.

5. The modular portable stackable device according to claim 4, wherein two neighboring electronic modules respectively have a seventh connector and an eighth connector, the seventh connector and the eighth connector are electrical connectors, and the two neighboring electronic modules are connected by the seventh connector and the eighth connector.

6. The modular portable stackable device according to claim 1, wherein the electronic module is a device for displaying time and date.

7. The modular portable stackable device according to claim 1, wherein the electronic module is a detecting device for detecting physiological signals of a human body.

8. The modular portable stackable device according to claim 1, wherein the electronic module is a sports measuring device.

9. The modular portable stackable device according to claim 1, wherein the electronic device is a tracking device.

10. The modular portable stackable device according to claim 1, wherein a circuit board is disposed in the electronic module, and the fourth connector is electrically connected to the circuit board.

* * * * *